United States Patent [19]

Saito et al.

[11] 4,345,882

[45] Aug. 24, 1982

[54] HERMETIC MOTOR COMPRESSOR

[75] Inventors: Fumitoshi Saito, Yawata; Sotomitsu Maeda, Kadoma; Toshio Uetsuji, Hirakata, all of Japan

[73] Assignees: Matsushita Electric Industrial Company, Limited; Matsushita Reiki Company, Limited, both of Osaka, Japan

[21] Appl. No.: 168,178

[22] Filed: Jul. 11, 1980

[30] Foreign Application Priority Data

| | | | |
|---|---|---|---|
| Jul. 13, 1979 | [JP] | Japan | 54-89549 |
| Jul. 13, 1979 | [JP] | Japan | 54-97065[U] |
| Mar. 10, 1980 | [JP] | Japan | 55-31450[U] |
| Mar. 10, 1980 | [JP] | Japan | 55-31451[U] |

[51] Int. Cl.[3] ..... F04B 21/00; F04B 35/04

[52] U.S. Cl. ..... 417/312; 417/902; 417/415; D15/9

[58] Field of Search ..... 417/902, 312, 313, 415, 417/419; 181/403, 200, 202, 198; 62/508, 296; D15/123, 122, 9; D23/2; D9/426, 352; 220/5 A, 4 B, 4 E, 72

[56] References Cited

U.S. PATENT DOCUMENTS

| | | | |
|---|---|---|---|
| 2,928,589 | 3/1960 | Davey | 417/312 |
| 3,187,995 | 6/1965 | Kjeldsen | 417/902 |
| 3,396,907 | 8/1968 | Valbjorn | 417/312 |

*Primary Examiner*—Richard E. Gluck
*Assistant Examiner*—Peter M. Cuomo
*Attorney, Agent, or Firm*—Lowe, King, Price & Becker

[57] ABSTRACT

A hermetic motor compressor comprises a casing which includes a dome-like upper casing and a dome-like lower casing. Each of the upper and lower casings has an engagement portion for telescopically engaging with each other. The stiffness of the upper casing is increased by making at least three corner portions close to the engagement portion. Crescent-shaped portions, curved surfaces, an apex portion and crest lines are also provided for the upper casing. This specific structure of the upper casing may be made also for the lower casing, and when both of the upper and lower casings have such construction, the corner portions of the upper casing and the corner portions of the lower casing are arranged alternatively so that the vibrating modes of respective casings offset each other. The shape of the entire casing may be spherical or ellipsoidal.

15 Claims, 17 Drawing Figures

HERMETIC MOTOR COMPRESSOR

BACKGROUND OF THE INVENTION

1. Field of the Invention

This invention generally relates to hermetic motor compressors which are usually used in a refregirator, an air conditioner and the like.

2. Description of the Prior Art

Conventional hermetic motor compressors are apt to be noise sources since resonance phenomena often occur between the compressor unit and the hermetic casing thereof.

Therefore, countermeasures, such as the adoption of a spherical shape for the hermetic casing have been taken hitherto. However, such a countermeasure merely makes the stiffness of the casing high to deviate the resonance frequency toward a higher frequency so that it has a very little effect on prevention of vibrations of lower modes and the resonance phenomena between respective excitation points. As a result, noise reduction to a sufficient extent could not be obtained with such a conventional countermeasure.

Namely, when measuring the lower mode vibrations in a conventional cylindrical or spherical casing such as shown in FIG. 1 or FIG. 2, it will be understood that vibrations having their antinode or loop at an excitation point X will occur at typical second (2000 Hz), third (2400 Hz) and fourth (3900 Hz) modes as shown in FIG. 3, FIG. 4 and FIG. 5. It is considered that this is caused by the fact that the horizontal cross-section of the hermetic casing is of a circular shape. Although the vibrations in the above described examples are caused by a single exiting point, if there are another exciting point, besides respective phases are opposite to each other, then it is predicted that a superimposition phenomenon with respect to both vibrations occurs to increase the degree of the vibrations.

SUMMARY OF THE INVENTION

The present invention has been developed in order to remove the disadvantages and drawbacks inherent to the conventional hermetic motor compressor.

It is, therefore, a primary object of the present invention to provide a hermetic motor compressor in which the magnitude of noises is remarkably reduced.

Another object of the present invention is to provide a hermetic motor compressor in which the magnitude of noises due to a resonance phenomenon, especially a superimposition phenomenon, of the hermetic casing is reduced.

In accordance with the present invention, there is provided a hermetic motor compressor comprising: (a) a motor-compressor unit; and (b) a casing for containing the motor-compressor unit, the casing having a dome-like upper casing and a dome-like lower casing, each of the upper and lower casings having an engagement portion for telescopically engaging with each other, and an apex portion at the top of the dome thereof, at least one of the upper and lower casings having; at least three corner portions in the vicinity of said engagement portion thereof; at least three crest lines respectively extending from the corner portions toward the apex portion; at least three crescent-shaped planes respectively placed between two of the corner portions, each of the crescent-shaped planes having a convexly curved side placed along a section of the engagement portion, and a concavely curved side; and at least three curved surfaces connecting two of the crest lines and the concavely curved side of the respective crescent-shaped planes.

In order to prevent the occurrence of resonance phenomena, which are the roots of high level noises, the stiffness of one or both of upper and lower casings is made high by providing a plurality of corner portions closed to the opening of each casing. This feature will be described in connection with a first embodiment. In a following second embodiment, the corner portions of the upper casing and the corner portions of the lower casing are arranged alternatively so that the nodes in the vibrating mode of one casing correspond to the antinodes or loops in the vibrating mode of the opposite casing resulting in the cancellation of the vibrating modes. In third and fourth embodiments, the shape of the casing is made ellipsoidal rather than spherical so that the vibration modes take a slightly distorted form making the casing difficult to resonate.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Figure 6:
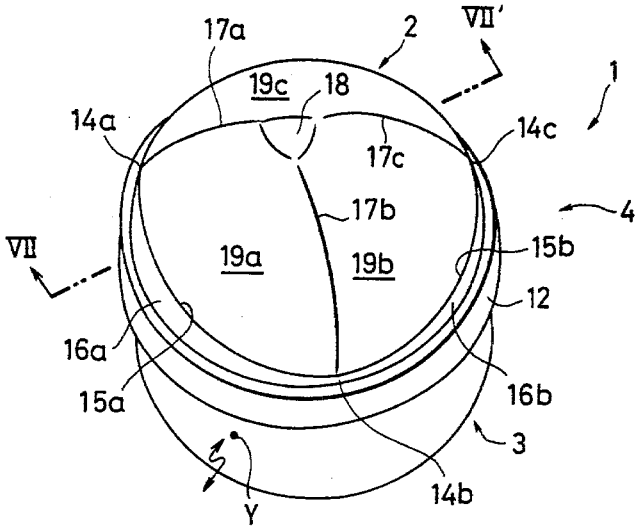
FIG. 6 is a schematic perspective view of a first embodiment of the hermetic motor compressor according to the present invention.

Referring to FIG. 6 a schematic perspective view of the first embodiment of the hermetic motor compressor according to the present invention is shown. The compressor proper is generally designated at a reference numeral 1, and comprises a hermetic casing 4 including a dome-like upper casing 2 and a dome-like lower casing 3, and a motor-compressor unit 7 which is a combination of an electrical motor 5 and a compressor element 6. The motor-compressor unit 7 is installed in the casing 4, and is supported elastically by means of a coil spring 8 which is fixedly connected to a base member (no numeral) fixedly attached to the inner surface of the lower casing 3. The above-mentioned motor-compressor unit 7 is of a customary type having a cylinder 9 for receiving a piston (not shown), which is reciprocally movable therein, a connecting rod 10, and a crankshaft (not shown) operatively connected to the drive shaft (no numeral) of the motor 5 so that the refrigerant gas in the cylinder 9 is compressed as the unit 7 operates.

Reference numerals 11 and 12 indicate engagement portions each having a circular cross-section, for the telescopic engagement between the upper and lower casings 2 and 3. The telescopic engagment portions 11 and 12 are shown to have a weld zone 13 so that the entire casing 4 is hermetically sealed. Reference numerals 14*a*, 14*b* and 14*c* indicate three corner portions disposed closed to the above-mentioned engagement portion 11 of the dome-like upper casing 2. These corner portions 14*a* to 14*c* are arranged in such a manner that the circumference of the engagement portion 11 is divided into thirds. Each of the corner portions 14*a* to 14*c* is defined by two adjacent curved surfaces which will be described hereinafter.

Since the horizontal cross-section of the engagement portion 11 is circular, the radius of the curvature at any point along the circumference of the engagement portions 11 is constant. Each of the above-mentioned corner portions 14*a* to 14*c* has a radius of curvature which is smaller than that at a point along the engagement portion 11 so that the above-mentioned two adjacent curved surfaces extending from each of the corner portions 14*a* to 14*c* are located inside the circle of the engagement portion 11 without protruding outside the circle. In different point of view, it can be said that the angle at each of the corner portions 14*a* to 14*c*, which is defined between two tangential lines of the two adjacent curved surfaces, is less than 180 degrees.

Reference numerals 15*a*, 15*b* and 15*c* indicate curved lines respectively connecting two of the above-mentioned corner portions 14*a* to 14*c*. The radius of curvature of these curved lines 15*a* to 15*c* is greater than the radius of curvature of the engagement portion 11 so that the length between two corner portions 14*a* and 14*b*, 14*b* and 14*c*, or 14*c* and 14*a* measured along the curved lines 15*a*, 15*b* and 15*c* is shorter than that measured along the circle which pass through these corner portions 14*a* to 14*c*.

Reference numerals 16*a*, 16*b* and 16*c* indicate crescent-shaped oblique planes enclosed by the engagement portion 11 and the respective curved lines 15*a* to 15*c*. Namely, each of the crescent-shaped oblique planes 16*a* to 16*c* has a convexly curved side and a concavely curved side, and the convexly curved side is located along the engagement portion 11, while the concavely curved side corresponds to each of the above-mentioned curved lines 15*a* to 15*c* respectively.

The dome-like upper casing 2 has an apex portion 18 at the top center thereof. The apex portion 18 may be a flat or curved plane having a triangle-like shape. Reference numerals 17*a*, 17*b* and 17*c* indicate crest lines respectively extending from the corner portions 14*a* to 14*c* toward the apex portion 18. Each of these crest lines 17*a* to 17*c* corresponds to the intersection between the above-mentioned two adjacent curved surfaces. References 19*a*, 19*b* and 19*c* indicate three curved surfaces each of which connecting two crest lines 17*a* and 17*b*, 17*b* and 17*c*, or 17*c* and 17*a* and one curved line, i.e. the concavely curved side, 15*a*, 15*b* or 15*c*.

In this first embodiment, the number of the corner portions 14*a* to 14*c* as well as the number of the curved surfaces 19*a* to 19*c* is three, and this number is preferably between three and about five. Although all of the embodiments of the present invention will be described with reference to such a casing having only three corner portions and three curved surfaces, the invention will be practiced in the same manner when the number of the corner portions and therefore the number of the curved surfaces are increased.

Figure 11:
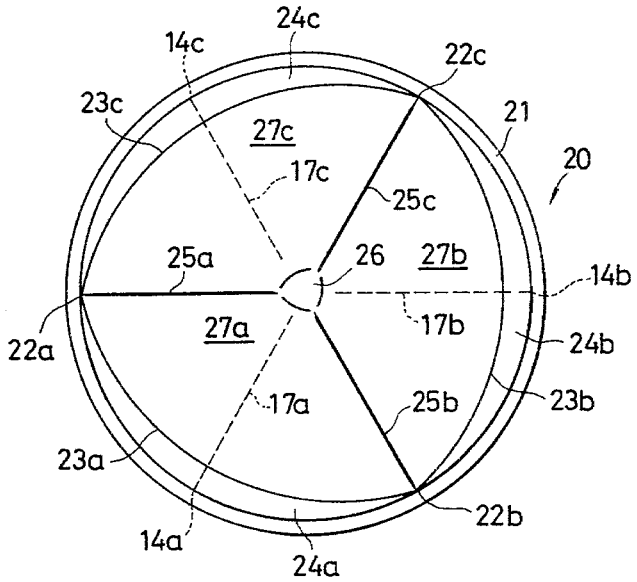
FIG. 11 is a bottom plan view of the hermetic motor compressor of FIG. 9.
Figure 9:
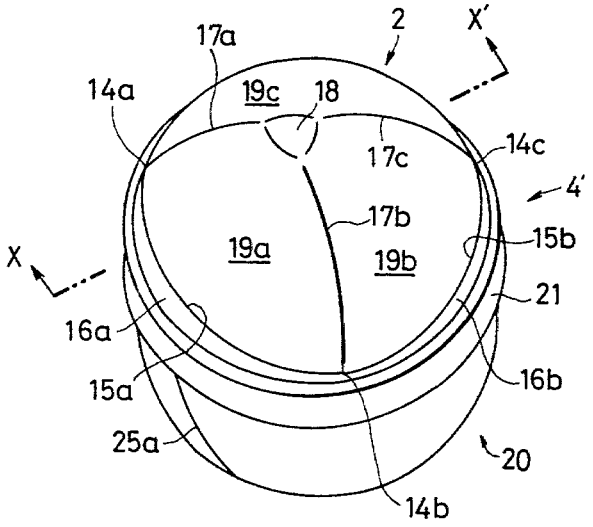
FIG. 9 is a schematic perspective view of a second embodiment of the hermetic motor compressor according to the present invention.
Figure 10:
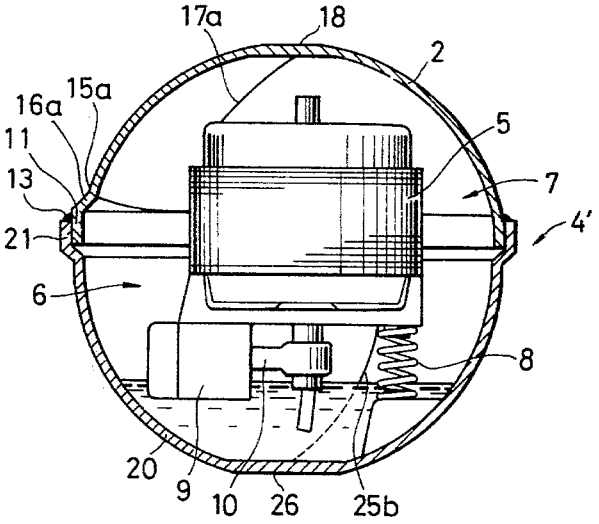
FIG. 10 is a cross-sectional view of the hermetic motor compressor of FIG. 9 taken along the line X—X'.

Reference is now made to FIGS. 9, 10 and 11 which show the second embodiment of the hermetic motor compressor according to the present invention. The second embodiment differs from the above-mentioned first embodiment in that the surface of the dome-like lower casing is curved in the same manner as the dome-like upper casing, and the upper casing and the lower casing are engaged with each other in such a manner that the crest lines of the upper and lower casings are arranged alternately or one after another. The second embodiment comprises a motor-compressor unit 7 which is the same in construction as in the first embodiment. The same elements as in the first embodiment are designated at like numerals.

FIG. 9 is a schematic perspective view of the second embodiment which comprises a hermetic casing 4' having an upper casing 2 and a lower casing 20. The construction of the upper casing 2 is the same as that of the first embodiment of FIG. 6, and therefore the description of the upper casing 2 is omitted.

FIG. 10 is a cross-sectional view of the second embodiment of FIG. 9 taken along the line X—X', and FIG. 11 is the bottom view of the second embodiment of FIG. 9. Namely, FIG. 11 illustrates the bottom of the lower casing 20.

The lower casing 20 comprises three corner portions 22*a*, 22*b* and 22*c* which are arranged in the vicinity of the engagement portion 21 of the lower casing 20. Each of these corner portions 22*a* to 22*c* has its radius of curvature smaller than that of the engagement portion 21, and these three corner portions 22*a* to 22*c* are arranged in such a manner that the circumference of the engagement portion 21 is substantially divided into thirds. Three curved lines 23*a*, 23*b* and 23*c* are provided between each two of these corner portions 22*a* to 22*c*, and the radius of curvature at each of these curved lines 23*a* to 23*c* is greater than that of the engagement portion 21 of the lower casing 20. References 24*a*, 24*b* and 24*c* indicate crescent-shaped oblique planes respectively enclosed by the engagement portion 21 and respective curved lines 23*a*, 23*b* and 23*c*. References 25*a*, 25*b* and 25*c* indicate crest lines which are respectively extending from respective corner portions 22*a*, 22*b* and 22*c* toward a bottom portion 26 which corresponds to the apex portion 18 of the upper casing 2. References 27*a*, 27*b* and 27*c* indicate three curved surfaces respectively enclosed by the crest lines 25*a*, 25*b* and 25*c*, and the curved lines 23*a*, 23*b* and 23*c*.

When the upper and lower casings 2 and 20 are telescopically connected or engaged, the crest lines 17*a*, 17*b* and 17*c* of the upper casing 2 will be arranged alternatively with respect to the crest lines 25*a*, 25*b* and 25*c* of the lower casing 20. Dotted lines indicative of the crest lines 17*a*, 17*b* and 17*c* of the upper casing 2 are shown in FIG. 11 for a better understanding of the relationship between these two groups of crest lines 17*a* to 17*c* and 25*a* to 25*c*.

Figure 1:
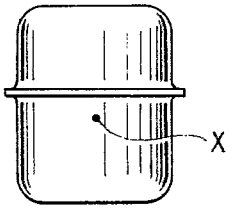
FIG. 1 PRIOR ART
FIG. 1 is an elevation of a conventional hermetic motor compressor.
Figure 2:
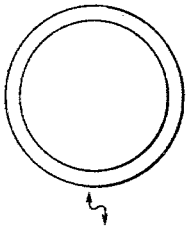
FIG. 2 PRIOR ART
FIG. 2 is an elevation of another conventional hermetic motor compressor.
Figure 3:
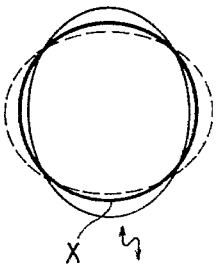
FIG. 3 PRIOR ART
FIG. 3 to FIG. 5 are explanatory views of the vibrations of lower, i.e. second, third and fourth, modes at the exciting point X of FIG. 1.
Figure 4:
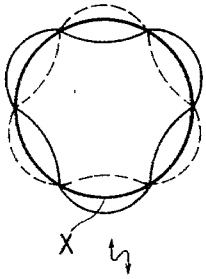
FIG. 4 PRIOR ART
Figure 5:
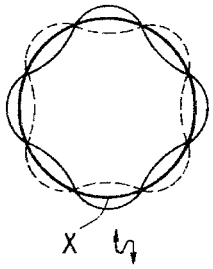
FIG. 5 PRIOR ART
Figure 12:
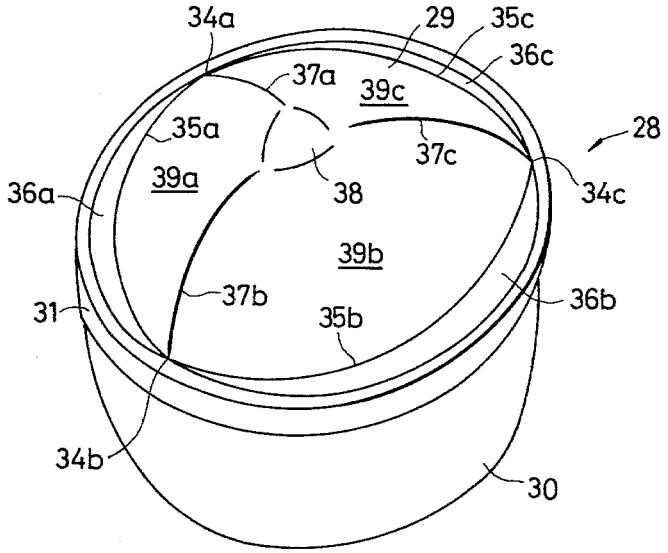
FIGS. 12 and 13 are schematic perspective and top plan views of a third embodiment of the invention.
Figure 13:
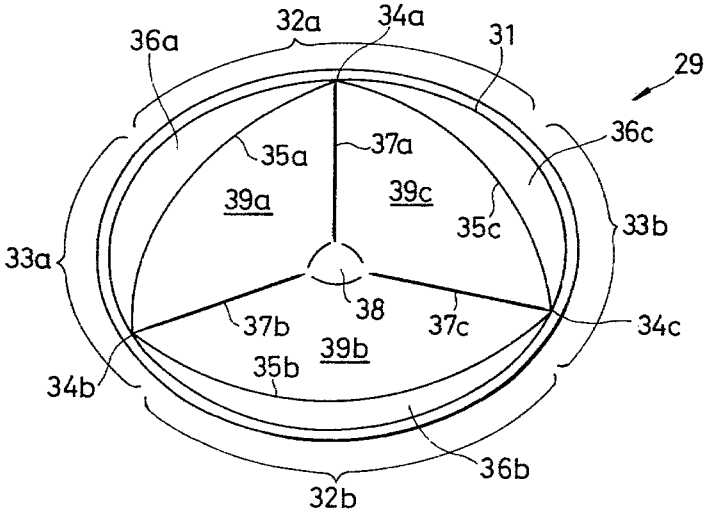

Reference is now made to FIG. 12 and FIG. 3 which show the third embodiment of the hermetic motor compressor according to the present invention. FIG. 12 is a perspective view and FIG. 13 is a top plan view of the third embodiment. As will be seen, the entire casing 4 of the third embodiment has an ellipsoidal shape rather than a spherical shape. In detail, the third embodiment hermetical motor compressor comprises an ellipsoidal casing 28 which consists of dome-like upper and lower casings 29 and 30. These dome-like upper and lower casings 29 and 30 are telescopically engaged with each other in the same manner as in the previous embodiments. The casing 28 has an engagement portion 31 so that the upper and lower casings 29 and 30 are hermetically connected by welding.

As is shown in FIG. 13, the horizontal cross-section of the engagement portion 31 has a pair of curved portions 32*a* and 32*b* the radius of curvature of which is relatively great, and another pair of curved portions 33*a* and 33*b* the radius of curvature of which is relatively small. Namely, these four curved portions 32*a*, 32*b*, 33*a* and 33*b* constitute an ellipse-like shape. References 34*a*, 34*b* and 34*c* indicate corner portions, and the first corner portion 34*a* is placed in the vicinity of one of the above mentioned two curved portions 32*a* and 32*b* each having a relatively great radius of curvature. Each of the corner portions 34*a*, 34*b* and 34*c* has an angle defined by two adjacent tangential lines. The angle at the first corner 34*a* is greater than those at the remaining two corners 34*b* and 34*c*. In other words, the radius of curvature at each of the corner portions 34*b* and 34*c* is smaller than that at the corner portion 34*a*. Accordingly, these two corners 34*b* and 34*c* are respectively located in the vicinity of the curved portions 33*a* and 33*b* each having a relatively great radius of curvature. References 35*a*, 35*b*, 35*c* indicate curved lines which are respectively located between the corner portions 34*a* and 34*b*, 34*b* and 34*c*, and 34*a* and 34*c*. References 36*a*, 36*b* and 36*c* indicate crescent-shaped planes which are respectively enclosed by the engagement portions 31 and the curved portions 35*a*, 35*b* and 35*c*. References 37*a*, 37*b* and 37*c* indicate crest lines respectively extending from the corner portions 34*a*, 34*b* and 34*c* toward an apex portion 38, while references 39*a*, 39*b* and 39*c* indicate curved surfaces respectively enclosed by the curved lines 35*a*, 35*b* and 35*c* and the crest lines 37*a*, 37*b* and 37*c*.

Figure 14:
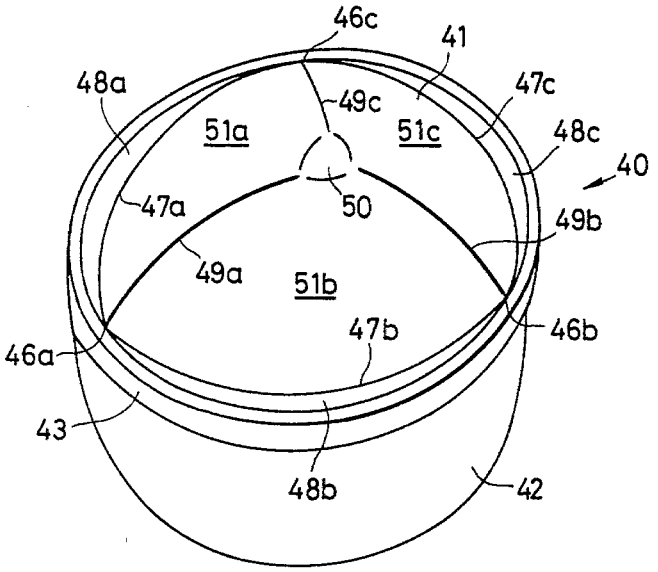
FIGS. 14 and 15 are schematic perspective and top plan views of a fourth embodiment of the invention.
Figure 15:
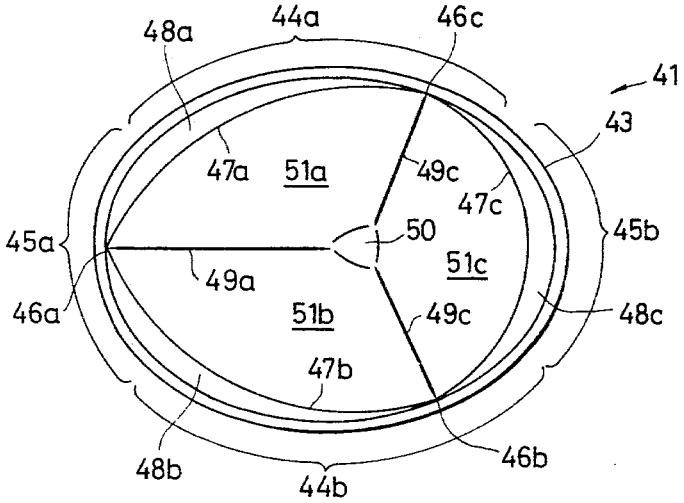

FIG. 14 and FIG. 15 show a fourth embodiment of the hermetic motor compressor according to the present invention. The fourth embodiment compressor also comprises an ellipsoidal casing 40 constructed of a dome-like upper casing 41 and a dome-like lower casing 42. The fourth embodiment differs from the above-described third embodiment in that the corner portions 46*a*, 46*b* and 46*c* are located at different positions with respect to the ellipse of the cross-section of the engagement portion 43. The upper casing 41 comprises three corner portions 46*a*, 46*b* and 46*c* in the vicinity of the engagement portion 43. The first corner portion 46*a* has a smaller radius of curvature than that at the second and third corner portions 46*b* and 46*c*. The first corner portion 46*a* is located close to one of the curved portions 45*a* and 45*b* each having a relatively small radius of curvature, while the remaining second and third corner portions 46*b* and 46*c* are located closed to curved portions 45*c* and 45*d* each having a relatively large radius of curvature. The upper dome-like casing comprises three crescent-shaped oblique planes 48*a*, 48*b* and 48*c*, three curved lines 47*a*, 47*b* 47*c*, three crest lines 49*a*, 49*b* and 49*c*, three curved surfaces 51*a*, 51*b* and 51*c*, and an apex portion 50 in the same manner as in the previous embodiments.

The operation of the above-described embodiments will be described in detail hereinafter. In the first embodiment of FIG. 6 to FIG. 8, each of the corner portions 14*a* to 14*c* has its radius of curvature which is smaller than the radius of curvature at the engagement portion 11. Therefore, the stiffness at the corner portions 14*a*, 14*b* and 14*c* is remarkably greater than that in a conventional dome like casing. As a result, the upper-dome like casing 2 assumes a vibration mode in which the nodes are located at the corner portions 14*a*, 14*b and 14c*. In other words, the positions of the nodes and antinodes or loops of the vibration mode have no relationship with the exciting point or points, while the exciting point(s) has some influence on the level of the vibrations.

Meanwhile, since the cross-section of the lower dome-like casing 3 has a circular shape, the lower casing 3 is apt to assume a neat lower mode having its loops at the exciting point(s). The upper and lower dome-like casings 2 and 3 are fixedly connected to each other, as described hereinabove, by the welded zone 13 so that the corner portions 14*a*, 14*b* and 14*c* influence on the way of the vibrations of the lower casing 3. Consequently, the vibrations of the entire casing 4 are severely restricted by the corner portions 14*a*, 14*b* and 14*c* so that the exciting power, which influences on the resonance of the hermetic casing 4, is limited and thus the level of the vibrations as well as the vibration thereof can be reduced when compared to the conventional casing.

In the second embodiment of FIG. 9 to FIG. 11, corner portions 14*a*, 14*b* and 14*c* are provided for the upper dome-like casing 2, while another corner portions 22*a*, 22*b* and 22*c* are provided for the lower dome-like casing 20. Accordingly, each of the upper and lower casings 2 and 20 is apt to assume a vibrating mode which is restricted in such a manner that the corner portions 14*a* to 14*c* and 22*a* to 22*c* respectively function as the nodes. Furthermore, in the second embodiment, the corner portions 14*a* to 14*c* of the upper casing 2 are arranged alternatively with respect to the corner portions 22*a* to 22*c* of the lower casing 20. This means that each node of one casing 2 or 20 is located at each antinode or loop of the other casing 20 or 2. As a result, this specific arrangement of the nodes and antinodes acts to suppress the magnitude of the vibrations of these casings 2 and 20 so that the resonance vibrations will be reduced.

In the third and fourth embodiments of FIG. 12 and FIG. 13, and of FIG. 14 and FIG. 15, the horizontal cross-section of each of the upper and lower casings 29, 30, 41 and 42 has an elliptic shape as described hereinbefore. Therefore, the lower mode vibrations take a slightly distorted form compared to the lower mode vibrations in a casing having a circular horizontal cross-section. Although the entire casing has a little difficulty to make a resonance phenomenon due to the slightly distorted form, resonance phenomenon cannot be satisfactorily prevented by only such a slightly distorted form. In each of the third and fourth embodiments, the radius of the curvature at each corner portion 34*a* to 34*c* and 46*a* to 46*c* is smaller than that at an adjacent portion on the engagement portion 31 or 43. Therefore, the same effects on the lower casing as those described with reference to the previous embodiments will be attained. Accordingly, the shape of the lower mode vibrations is complicated so that the entire casing 28 or 40 is not apt to resonate at a specific frequency.

The effect in connection with noise reduction which is obtained by the first embodiment of FIGS. 6 to 8 will be described hereinbelow with reference to experimental results.

Figure 16:
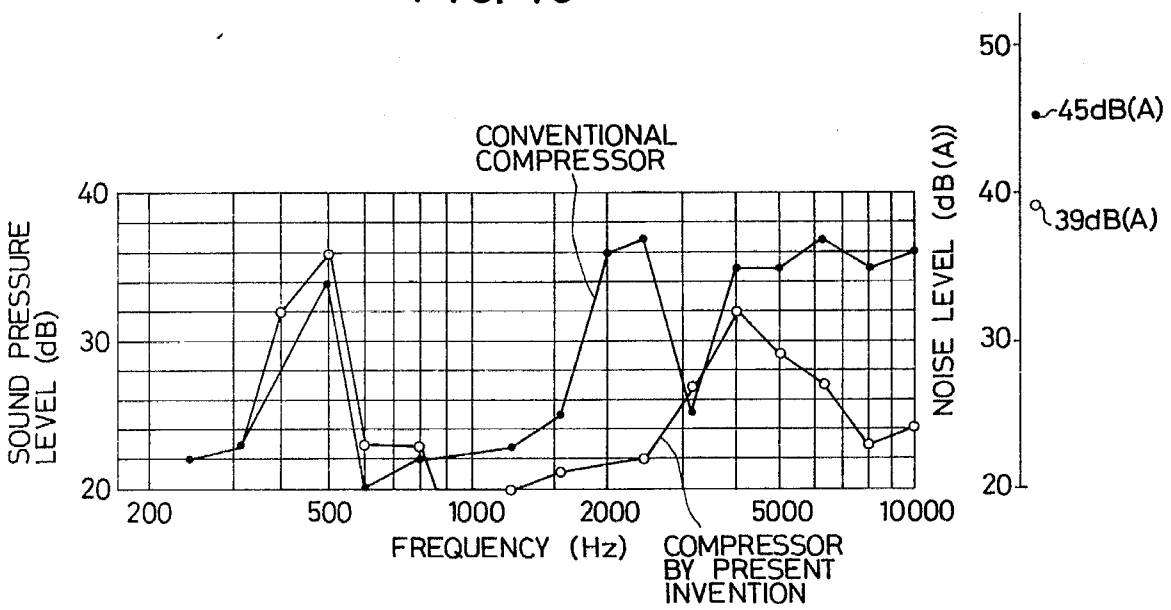
FIG. 16 is a graphical representation showing the noise levels of the conventional compressor and of the first embodiment.

FIG. 16 is a graphical representation showing the sound pressure level with respect to frequencies. In FIG. 16, black circles indicate the data of the first embodiment of the present invention, while white circles indicate the data of the conventional hermetic motor compressor having a cylindrical casing. The motor compressor was operated substantially in the same condition as it usually operates, and the data are of the steady state. In detail, the pressure of the refrigerant at the higher side was 13 $kg/cm^2$ G, and 0.3 $kg/cm^2$ G at the lower side.

As will be seen in the graph of FIG. 16, the sound pressure level of the hermetic motor compressor according to the present invention is slightly above that of conventional apparatus in a range blow 1,000 Hz. However, this difference is negligibly small, and therefore, the sound pressure level below 1,000 Hz of the first embodiment can be regarded as substantially the same as that of the conventional apparatus. On the contrary, in a range above 1,000 Hz, the sound pressure level of the first embodiment is remarkably lower than that of the conventional apparatus. Especially, noise level in the vicinity of 2,000 Hz, at which human's ears are sensitive, has been lowered by approximately 15 dB or more according to the present invention. In addition, the reduction in the sound pressure level in the higher frequency range above 5,000 Hz is also remarkable.

Expressing the noise level in the form of an overall value, the noise level of the conventional apparatus is 45 dB(A), while the noise level of the first embodiment of the present invention is 39 dB(A). Namely, noise reduction by 6 dB(A) is attained by the present invention, and it means that the noise level has been reduced to the half.

Figure 17:
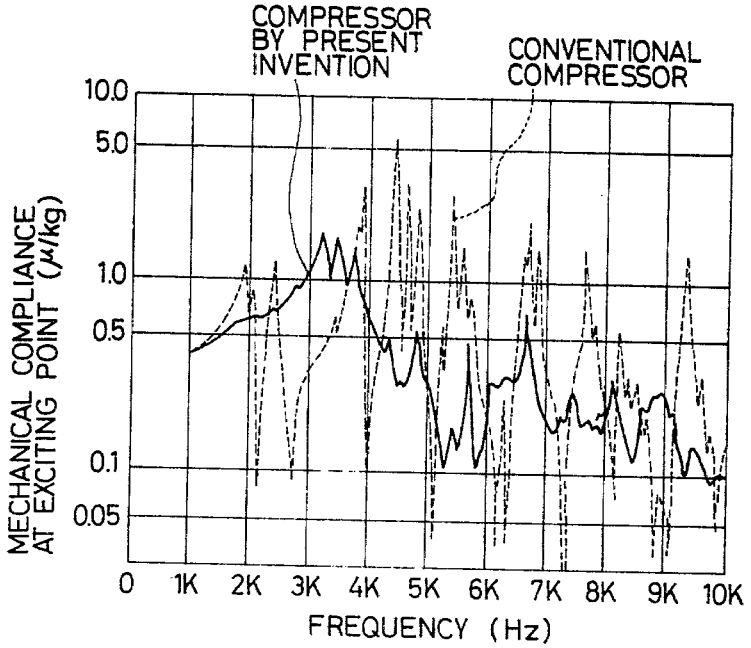
FIG. 17 is a graphical representation showing the resonance characteristics of the conventional compressor and of the first embodiment.

FIG. 17 is a graphical representation showing the mechanical compliance at the driving point with respect to the frequency. The data of FIG. 17 was obtained by exciting at a point Y shown in FIG. 6, and this point Y was also used as a measuring point. In FIG. 17, the compliance of the conventional apparatus is shown by a dotted line, while the compliance of the first embodiment is shown by a solid line. It will be recognized that the first peak which appears in the vicinity of 2,000 Hz as shown by the dotted line is now shown by the solid line in a frequency range above 3,000 Hz. It will be understood, therefore, that the natural frequency in the audio frequency has been decreased in the first embodiment of the present invention compared to the conventional apparatus, while the vibrational energy of the entire casing has been reduced. Furthermore, the peak levels in the compliance curve in a frequency range above 3,000 Hz are lower than those in the conventional apparatus. From the above, it will be understood that the vibrational energy in such a high frequency range has been also decreased according to the present invention.

Although it has been described in the above with reference to preferred embodiments, that corner portions as well as crest lines are provided for one or both of the upper and lower dome-like casings, the corner portions and the crest lines do not necessarily have to be intersections of lines or curved surfaces. In other words, each of the corner portions may be a curved surface having a relatively small radius of curvature, and in the same manner each of the crest lines may be a curved surface having a relatively small radius of curvature.

Figure 7:
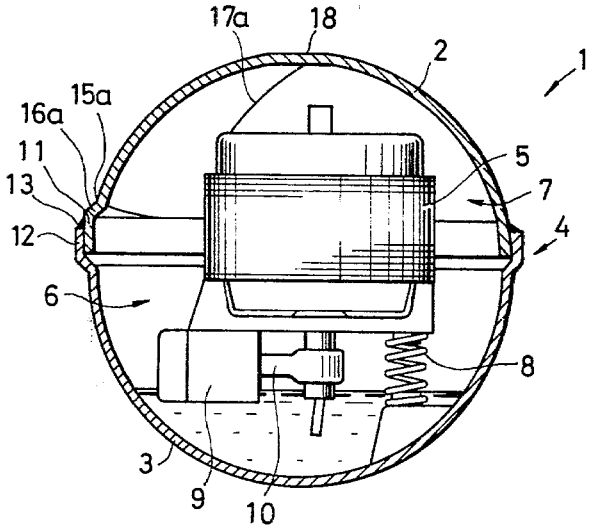
FIG. 7 is a cross-sectional view of the hermetic motor compressor of FIG. 6 taken along the line VII—VII'.
Figure 8:
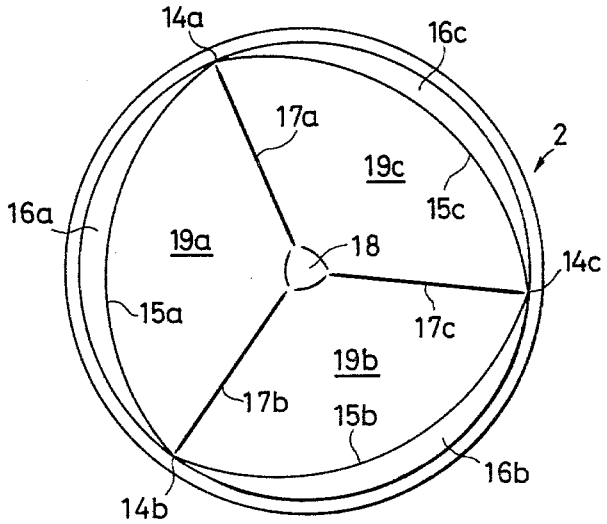
FIG. 8 is a top plan view of the hermetic motor compressor of FIG. 6.

As shown in FIG. 7 and FIG. 10, one or more crest lines 17*a* and 25*b* are shown to be on the inner surface of the dome-like upper casing 2 or the inner surfaces of the dome-like upper and lower casings 2 and 20. Namely, the inner surface of the upper and/or lower casing is curved to the curved surface of the outer surface thereof. The upper and lower casings may be produced by a press forging techinque.

The above described embodiments are just examples of the present invention, and it will be understood for those skilled in the art that many modifications and variations may be made without departing from the spirit of the present invention.

What is claimed is:

1. A hermetic motor compressor comprising:

(a) a motor-compressor unit; and (b) a casing for containing said motor-compressor unit, said casing having a dome-like upper casing and a dome-like lower casing, each of said upper and lower casings having an engagement portion for engaging with each other, and an apex portion at the top of the dome thereof, at least one of said upper and lower casings having:

at least three corner portions in the vicinity of said engagement portion thereof;

at least three crest lines respectively extending from said corner portions toward said apex portion;

said casing having at least three crescent-shaped planes, each plane being placed between a pair of said corner portions, each of said crescent-shaped planes having a convexly curved side placed along a section of said engagement portion, and a concavely curved side; and at least three curved surfaces connecting two of said crest lines and said concavely curved side of respective crescent-shaped planes.

2. A hermetic motor compressor as claimed in claim 1, wherein both of said upper and lower dome-like casings have like construction, said corner portions of said upper casing and the corner portions of said lower casing being arranged alternatively.

3. A hermetic motor compressor as claimed in claim 1, wherein the radius of curvature at each of said corner portions is smaller than the radius of curvature at said engagement portion.

4. A hermetic motor compressor as claimed in claim 1, wherein the radius of curvature at each of said concavely curved side is greater than the radius of curvature at said engagement portion.

5. A hermetic motor compressor as claimed in claim 1, wherein said corner portions are located in such a manner that the circumference of said engagement portion is divided into thirds.

6. A hermetic motor compressor as claimed in claim 1, wherein said apex portion comprises a flat plane.

7. A hermetic motor compressor as claimed in claim 1, wherein said apex portion comprises a curved surface.

8. A hermetic motor compressor as claimed in claim 1, wherein said casing including said upper and lower casings is substantially spherical.

9. A hermetic motor compressor as claimed in claim 1, wherein said casing including said upper and lower casings is substantially ellipsoidal.

10. A hermetic motor compressor as claimed in claim 9, wherein the horizontal cross-section of said engagement portion of said upper casing comprises a pair of curved portions having a relatively great radius of curvature and a pair of curved portions having a relatively small radius of curvature, and wherein said upper casing comprises three of said corner portions.

11. A hermetic motor compressor as claimed in claim 10, wherein the first corner portion is located in the vicinity of one of said curved portions having a relatively great radius of curvature, while the second and third corner portions are respectively located in the vicinity of said curved portions having a relatively small radius of curvature.

12. A hermetic motor compressor as claimed in claim 11, wherein the radius of curvature at said first corner portion is greater than those at the second and third corner portions.

13. A hermetic motor compressor as claimed in claim 10, wherein the first corner portion is located in the vicinity of one of said curved portions having a relatively small radius of curvature, while the second and third corner portions are respectively located in the vicinity of said curved portions having a relatively great radius of curvature.

14. A hermetic motor compressor as claimed in claim 13, wherein the radius of the curvature of said first corner portion is smaller than those at said second and third corner portions.

15. A hermetic motor compressor as claimed in claim 1, wherein each of said engagement portions has a shape such that said upper and lower casings are telescopically engaged with each other.

* * * * *